US005804829A

United States Patent [19]

Palmer

[11] Patent Number: 5,804,829

[45] Date of Patent: Sep. 8, 1998

[54] PROGRAMMABLE INFRARED SIGNAL BEACON

[75] Inventor: Gary L. Palmer, Vinton, Va.

[73] Assignee: ITT Corporation, New York, N.Y.

[21] Appl. No.: 760,171

[22] Filed: Dec. 3, 1996

Related U.S. Application Data

[63] Continuation of Ser. No. 488,575, Jun. 8, 1995, abandoned.

[51] Int. Cl.[6] ..... G08B 5/22

[52] U.S. Cl. ..... 250/504 H; 340/321

[58] Field of Search ..... 250/504 H; 116/20, 116/209; 359/185; 348/734; 455/151.2; 340/321

[56] References Cited

U.S. PATENT DOCUMENTS 4,267,606 5/1981 Stelter et al. ..... 359/185

5,414,405 5/1995 Hogg et al. ..... 340/321

OTHER PUBLICATIONS

Kohavi,"Switching and Finite Automata Theory",second edition,1978,pp.275–299.

*Primary Examiner*—Jack I. Berman
*Attorney, Agent, or Firm*—Plevy & Associates

[57] ABSTRACT

A portable signal beacon adapted to be worn on the body so as to provide a discernable signal to a remote observer during low light conditions. The signal beacon includes a lightweight housing containing a light source, such as a bank of infrared LEDs. A signal generating device is also contained within the housing, wherein the signal generating device controls the activation of the light source and provides the light source with one of a plurality of different flashing sequences. At least one selection switch is provided that enables the user of the beacon to select which of the plurality of flashing sequences will be transmitted by the light sources.

20 Claims, 4 Drawing Sheets

| BINARY CODE | SIGNAL | FLASH SEQUENCE |
|---|---|---|
| 001 | S.O.S. | • • • — — — • • • |
| 010 | WATER | — • • — • — — • — • |
| 011 | FOOD | • • — • — — — — — — • • |
| 100 | DANGER | — • • • — — • — • • — • |
| 101 | CUSTOM | CUSTOM |
| 110 | STROBE SIGNAL | — — — — |
| 111 | RESET | 0 |
| 000 | STANDBY | 0 |

*FIG. 4*

PROGRAMMABLE INFRARED SIGNAL BEACON

This is a continuation of application Ser. No. 08/488,575, filed on Jun. 8, 1995, entitled PROGRAMMABLE INFRARED SIGNAL BEACON now abandoned.

FIELD OF THE INVENTION

The present invention relates to signal beacons carried by soldiers or woodsmen to provide a visual locating signal during low light conditions. More particularly, the present invention relates to signal beacons that can be programmed to signal one of a number of coded messages, either in the visible light range of the spectrum or the infrared range of the spectrum.

BACKGROUND OF THE INVENTION

Flashing lights have long been used to send signals at night or to indicate the presence of an object in the darkness. For example, Paul Revere was signaled by a light that the British were coming. Airplanes use flashing strobes so that they can be seen at night, and tall structures are adorned with flashing lights so airplanes can identify those structures in the darkness. The advantages of using flashing lights to send a signal include the fact that flashing lights are far more economical to use than radio wave based or radar based signalling systems. But perhaps the largest advantage of using light signals is that light signals immediately tell the receiver of the signal the exact location of the source of the signal without the need of sophisticated electronic equipment. As such, a pilot does not have to look at a radar screen to see a tall structure, rather the flashing lights allow the pilot to see the structure with his/her own eyes.

As a result, the use of flashing lights is the signaling medium of choice in situations where the purpose of the signalling is to quickly and inexpensively identify the location of a person or an object in the dark. See for example, U.S. Pat. No. 5,117,766 to Nechushtan et al., entitled PERSONNEL MARKER where small lights are used to identify the position of soldiers on maneuvers in the dark. An obvious disadvantage of using lights to identify people or objects in the dark, is that in military applications such signal lights reveal the location of soldiers and objects to the enemy. As such, the use of a visible light on a soldier, such as is shown like that in the Nechushtan patent, is fine for training but would be disastrous in a real combat environment where the enemy could easily see the location of soldiers in the darkness. A paradox is therefor created in military applications wherein a system is required to allow friendly forces to identify objects and each other at night but not allow unfriendly forces to do the same.

A solution to this paradox comes from the fact that most U.S. Military forces, both airborne and land based, that operate at night are commonly equipped with night vision devices that convert infrared, near-infrared and/or low intensity, low frequency visible light into an easily viewable image. By flashing an infrared light, only people looking at the source of the signal with night vision equipment would be able to see the signal. An example of one situation that has adopted the inared solution is shown in U.S. Pat. No. 4,912,334 to Anderson, entitled INFRARED AIRCRAFT BEACON LIGHT. The Anderson patent discloses infrared aircraft beacons that enable pilots with night vision goggles to fly in formation and see the surrounding aircraft in a manner that does not give away the position of the aircraft to enemy forces on the ground. A similar system is disclosed in U.S. Pat. No. 5,159,480 to Gordon et al., entitled INFRARED WIDEBEAM COMMUNICATION TRANSMITTER, wherein navel ships send and receive infrared light signals that can only be viewed by a person using a night vision device.

Outside of the military, night vision devices are not widely used. As such, outside the military there are few location signaling devices that operate within the infrared region of the spectrum. Consequently, in a domestic setting there are very few sources of light that can only be viewed through the use of a night vision device. The use of an infrared location beacon in a domestic setting would therefore be a highly unusual occurrence. Accordingly, infrared beacons would be an effective way to identify a single person or object in a city, suburban or rural setting in a landscape that contains numerous other light sources.

It is therefore an object of the present invention to provide an infrared beacon signaling device that can be carried by an individual and can be used to send a detectable infrared signal without regard to the presence of other light sources or the lack thereof.

It is a further object of the present to provide an infrared signaling device that can be worn on the body and activated in a time of distress.

It is yet another object of the present invention to provide a programmable infared signalling device that can transmit a number if preprogrammed coded signals depending upon the needs of the persons utilizing the signalling device.

SUMMARY OF THE INVENTION

The present invention is a portable signal beacon adapted to be worn on the body so as to provide a discernable signal to a remote observer during low light conditions. The signal beacon includes a lightweight housing containing a light source, such as a bank of infrared LEDs. A signal generating device is also contained within the housing, wherein the signal generating device controls the activation of the light source and provides the light source with one of a plurality of different flashing sequences. At least one selection switch is provided that enables the user of the beacon to select which of the plurality of flashing sequences will be transmitted by the light source. The light source may generate either infrared light and/or visible light. If a light source is used that generates visible light, a filter cap is provided that attaches to the beacon housing over the light sources. The filter cap permits only infrared light therethrough. Thus, by placing the filter cap over the light source, the signal beacon can be selectively altered between a visible light beacon and an infrared light beacon.

BRIEF DESCRIPTION OF THE DRAWINGS

For a better understanding of the present invention, reference is made to the following description of an exemplary embodiment thereof, considered in conjunction with the accompanying drawings, in which:

FIG. 4 is a chart showing a sample menu of signals that the present invention signal beacon is capable of transmitting.

DETAILED DESCRIPTION OF THE PRESENT INVENTION

Although the present invention programmable infrared beacon can be attached to any object or can be carried on any part of the body, the present invention is especially suited to be worn as an arm band or hat band assembly, Accordingly, the present invention will be described as part of a band assembly that can be worn around the arm or around a hat in order to set forth the best mode contemplated for the invention.

Figure 1:
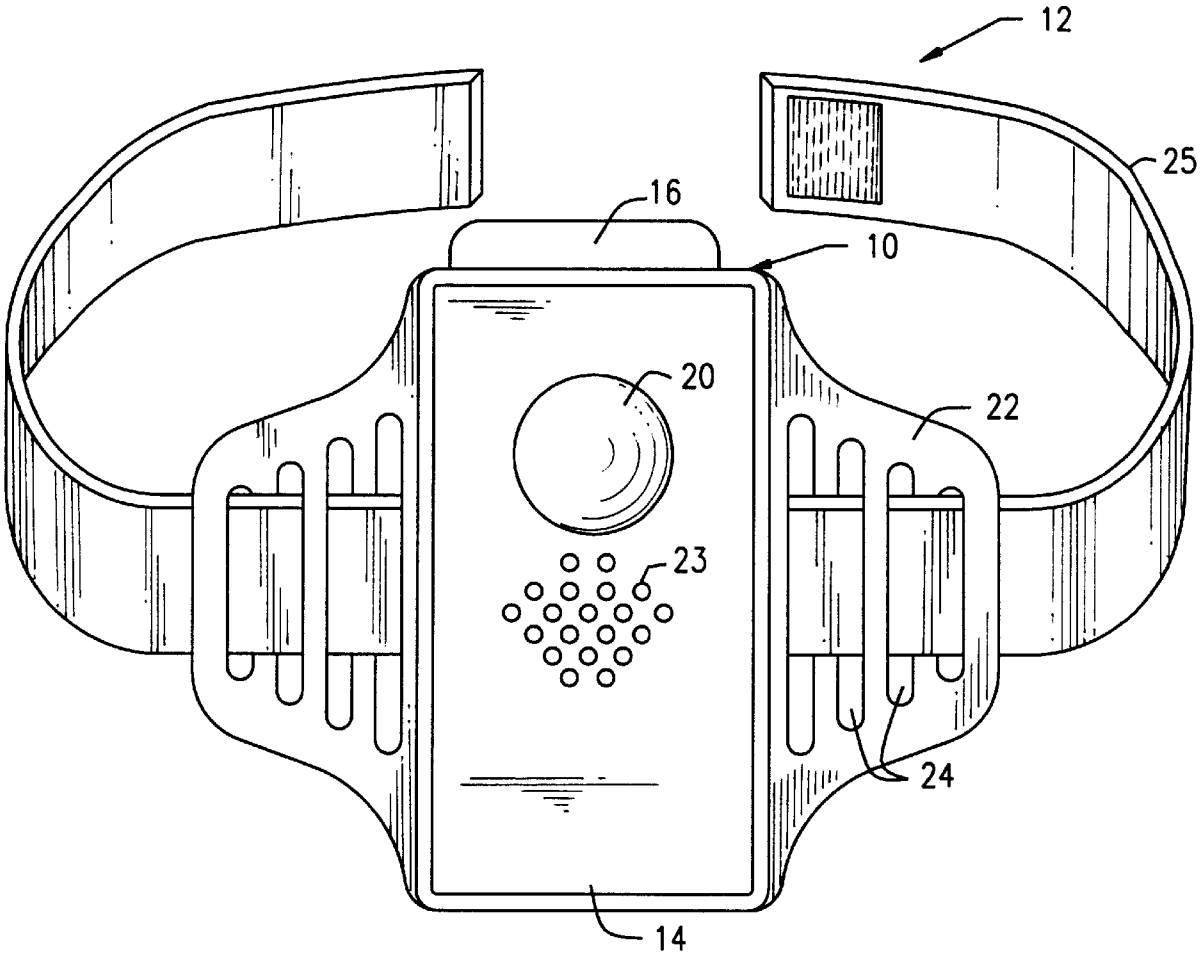
FIG. 1 is a front view of one preferred embodiment of the present invention signal beacon, shown in conjunction with an arm band assembly to facilitate further consideration and discussion.

Referring to FIG. 1 one preferred embodiment of the present invention programmable infrared beacon 10 is shown as part of a band assembly 12. The infrared beacon 10 is contained within a generally rectangular shaped housing 14. An infrared light source 16 extends upwardly from the top surface 17 of the housing 14. As will later be explained, the infrared light source 16 is capable of transmitting pulses of infrared light in one of several signaling sequences that are stored in an electronic memory or in a custom signaling pattern entered by the operator of the device. A large push button 20 is disposed on the housing 14 in an area that is easily accessed by the operator of the device. As will also be later explained, the push button 20 enables the operator to access signaling sequences stored in memory or enter a custom signaling pattern to be transmitted. An optional speaker port 23 is disposed on the housing 14. The speaker port 23 protects a speaker element that provides an audible signal that is indicative of the light signal being emitted by the light source 16. This enables a person using the infrared beacon to identify the signal being transmitted, even if that person cannot see or comprehend the light signal being emitted.

In the shown embodiment, the infrared beacon 10 is joined to a band element 22 to create the overall band assembly. The band element 22 is a flexible support that couples to the beacon housing 14 so as to provide a convenient surface upon which to attach a strap 25 to the infrared beacon 10. The band element 22 shown has a plurality of slots 24 formed through its structure on either sides of the infrared beacon 10. The strap 25 can be weaved through the slots 24 so as to provide a secure attachment between the band element 22 and the strap 25. The strap 25 is preferably elastic having hook and loop fasteners 26 at its two ends, thereby enabling the strap to be placed around a variety of different sized arms or hat bands.

Figure 2:
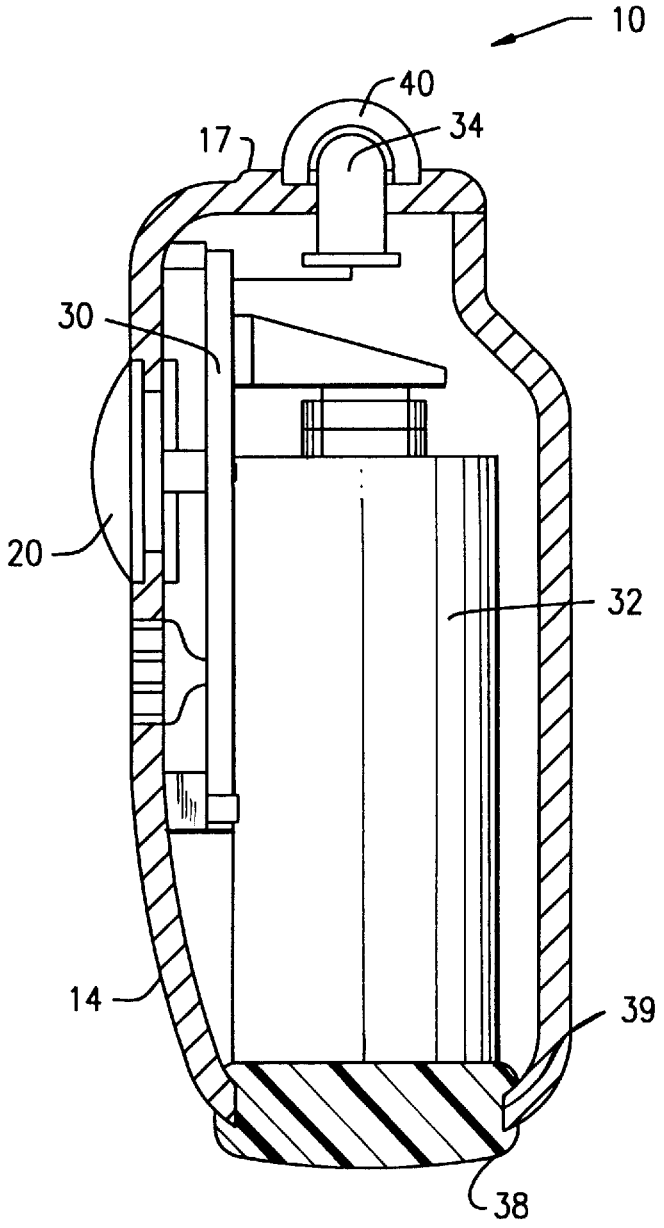
FIG. 2 is a cross-sectional view of the embodiment of the present invention signal beacon shown in FIG. 1, viewed along section line 2—2.

Referring to FIG. 2, it can be seen that inside the beacon housing 14 is disposed a printed circuit board 30, a battery 32, and a plurality of light emitting diodes (LEDs) 34. The printed circuit board 30 contains the control logic used to flash the LEDs 34, as will be later explained. The push button 20 extends into the housing 14 and is coupled to the circuit board 30. As such, the push button 20 is the only variable input used to actuate and control the circuitry contained on the circuit board 30. In the shown embodiment, the battery 32 is a commercially available 9 volt battery that is coupled to the circuit board 30 within the beacon housing 14. The battery 32 is accessed through a removable elastomeric grommet 38 that plugs an access port 39 on the bottom of the beacon housing 14. It will be understood that the use of a 9 volt battery is merely exemplary and any other battery or series of batteries can be used depending upon the power requirements of the LEDs 34 and the circuit board 30. An optional speaker element 21 or another such indicator may also be coupled to the circuit board 30. In the shown embodiment, the speaker element 21 aligns with speaker port 23 in the housing 14 and provides an audible signal that identifies what light signal is being emitted by the LEDs 34.

The LEDs 34 extend through the beacon housing 14 so as to be visible from a point external the housing 14. In the preferred embodiment, the LEDs 34 extend through the top surface 17 of the beacon housing 14. The LEDs are oriented to emit light up and away from the top surface 17 of the housing 14. As a result, if the infrared beacon 10 is worn on a person's body so that the top surface 17 of the housing 14 faces skyward, the light emitted from the LEDs 34 will be directed essentially skyward. The LEDs 34 can either emit visible light or can emit purely infrared light. In the preferred embodiment, the LEDs 34 emit visible light at the red end of the visible spectrum, wherein the light emitted includes component frequencies in the near infrared region. A filter cover 40 is provided that filters out the visible light emitted by the LEDs 34, thereby permitting only the infrared frequencies to be transmitted. The filter cover 40 is preferably removable from the beacon housing 14. As a result, the operator of the infrared beacon 10 can control what type of signal is being transmitted by selectively removing the filter cover 40. For example, if the beacon operator wanted to transmit a visible signal to people not having night vision devices, the filter cover 40 can be removed. However, if the beacon operator wants to transmit an infrared signal visible only via night vision devices, the filter cover 40 can be left in place.

Figure 3:
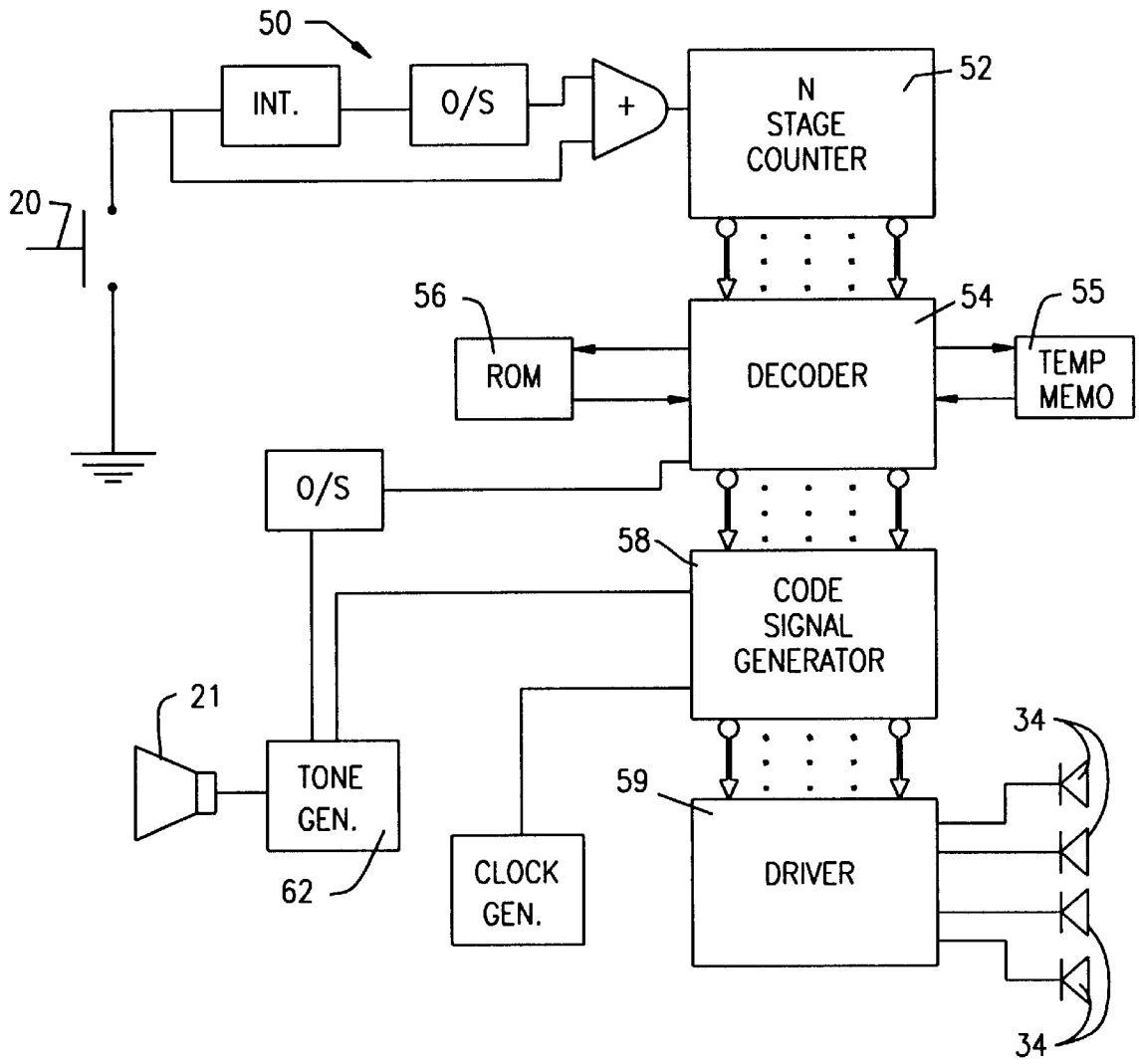
FIG. 3 is a schematic of one preferred embodiment of the circuit logic of the present invention signal beacon.

It will be understood that if the LEDs 34 produce only infrared light, then the filter cover 40 need not be used. Rather, the filter cover 40 could merely be a transparent cover that helps protect the infrared LED's 34 from damage. To operate the infrared beacon 10, the operator engages the push button 20. Depending upon the number of times the push button 20 is depressed and/or the sequence by which the push button 20 is depressed, the beacon operator can recall a preprogrammed signal sequence or enter a custom signal sequence. Referring to FIG. 3 one preferred embodiment of the control logic used by the infrared beacon is illustrated. As can be seen as push button 20 is depressed, the signal passes through a debouncing circuit 50 to an N State Counter 52 that counts the number of times the state of the push button changes in a given unit of time. Once the number (N) of push button depressions has been counted, a Decoder 54 converts the count number into binary code. Depending upon the code entered, via the push button 20, one of two interactions can occur. A ROM memory 56 is provided that contains a number of preprogrammed signal sequences. The signal sequences can be recalled from ROM memory 56 by the appropriate binary code input. Looking at FIG. 4 in conjunction with FIG. 3, it can be seen that if the push button 20 were pushed once, the binary code 001 would be produced. This binary code retrieves the signal for "S.O.S." from ROM memory 56. Similarly, if the push button 20 were pushed twice, the binary code 010 would be produced which would retrieve the signal for "WATER" from the ROM memory 56. Once the appropriate signal is retrieved from memory, the signal is read by a Code Signal Generator 58 that converts the signal into the appropriate morse code signal. The morse code signal is then read by the LED Driver 59 that flashes the LEDs 34 in the appropriate sequence. The flashing sequence may repeat indefinitely until stopped or may repeat for a predetermined period of time .

In FIG. 4, it can be seen that the Decoder 54 provides a three bit binary code that provides eight possible entries. As has been mentioned, some of the entries correspond to preprogrammed signals stored in memory such as S.O.S., WATER, FOOD, DANGER and the like. However, at least one of the binary code entries triggers a second interaction, wherein the Decoder 54 interacts with a temporary programmable memory 55. The temporary programmable memory 55 is capable of temporarily storing a custom signal code of a predetermined length. Using the push button 20, a custom morse code signal can be entered and stored within the temporary programmable memory 55, wherein the custom morse code can be repeatedly transmitted via the LEDs 34. In this manner, a person wearing the infrared beacon can transmit a custom signal to any person observing the infrared beacon with a night vision device.

Since the shown embodiment of the infrared beacon has only a single push button 20 to input information, it may be difficult for the person using the infrared beacon to remember how many times the push button 20 has been engaged. Accordingly, the present invention may come equipped with an optional audible or visual indicator. In FIG. 3 a tone generator 62 is shown coupled to speaker 21. The tone generator 62 is coupled to the code signal generator 58 wherein the tone generator 62 generates a tone indicative of the code being flashed. For example, the tone generator 62 may generate tones in morse code that correspond to the morse code signal being transmitted. Alternatively, the tone generator 62 may generate a tone indicative of the eight possible signal choices shown in the preferred embodiment. The use of a tone generation is merely exemplary. In alternate embodiments the tone generator can be replaced by a voice synthesizer that states the message being sent or a LCD display that displays the message being sent.

In an alternate embodiment of the present invention infrared beacon, its circuitry can be simplified to reduce the complexity and cost of the device. Referring back to FIG. 1, the infrared beacon 10 may just have the ability to transmit one or two message signals. These message signals may be generated by pulse generator circuits hard wired directly on the circuit board, thereby eliminating the need for memory cells and sophisticated N stage counter circuits. For instance, in one preferred embodiment of the infrared beacon 10, the beacon has the ability only to transmit two signals. One of those signals is a periodic strobe used to identify the location of the beacon. The second signal is a S.O.S. morse code signal, identitying the need for help. As with previous embodiments, the signal choice is selected via the push button 20. When the push button 20 is depressed once, the periodic strobe begins. When the push button 20 is pressed twice, the S.O.S. signal begins. In such an embodiment, the use of a signal indicator is not required since the operator of the beacon is offered only two selections from which to choose. Furthermore, if the signal is being transmitted in any visible light frequency, the operator can easily ascertain whether the signal being transmitted is the periodic strobe or the morse code signal.

It will be understood that the embodiments of the infrared beacon described above are merely exemplary and that a person skilled in the art may make many variations and modifications to those embodiments using functionally equivalent components and circuitry. More specifically, it should be understood that numerous circuits can be developed that are capable of generating a predetermined morse code signal. Any such circuit controllable by at least one push button can be used in conjunction with this invention. All such variations and modifications are intended to be included within the scope of the present invention as defined in the appended claims.

What is claimed is:

1. A signal beacon, comprising:

a housing;

a light source coupled to said housing wherein said light source is discernable from a point external of said housing;

signal generating means contained within said housing for generating at least two separate flashing information signals, wherein each of said flashing information signals are capable of being transmitted by said light source and conveying a separate message; and selection means for selecting which of said flashing signals is to be transmitted by said light source, said selection means including:

a single user-controlled push button operable to generate a pulse for each activation of said push button by said user within a given time interval;

a counter for sensing predetermined user changes to said selection means, said counter being coupled to said signal generating means and responsive to said generated pulses within said given time interval for counting the number of pulses received to produce an output signal indicative of the number of times said push button was depressed during said time interval and corresponding to each of said flashing information signals transmitted by said light source.

2. The signal beacon according to claim 1, wherein said light source transmits infrared light.

3. The signal beacon according to claim 1, wherein said push button is disposed on said housing in a manner that enables the tactile engagement of said push button by a person using said signal beacon.

4. The signal beacon according to claim 1, wherein said light source includes a plurality of LEDs.

5. The signal beacon according to claim 4, wherein said light source further includes a filter element that covers said plurality of LEDs.

6. The signal beacon according to claim 5, wherein said filter element is an infrared filter that enable essentially only infrared wavelengths to pass therethrough.

7. The signal beacon according to claim 5, wherein said filter element is selectively removable from said plurality of LEDs.

8. The signal beacon according to claim 1, wherein at least one of said flashing signals is a morse code signal.

9. The signal beacon according to claim 8, wherein said morse code signal is selected from a group consisting of the signals for S.O.S., FOOD, WATER and DANGER.

10. The signal beacon according to claim 1, wherein at least one of said flashing signals is a periodic strobe.

11. The signal beacon according to claim 1, further including an attachment means, coupled to said housing, for attaching said signal beacon to a person, wherein said signal beacon is carried by said person.

12. The signal beacon according to claim 11, wherein said housing has a top surface that faces upwardly when attached to a person via said attachment means, said top surface having said light source disposed thereon whereby light produced by said light source is directed primarily upwardly.

13. The signal beacon according to claim 1, further including a memory coupled to said signal generating means, wherein at least one of said flashing signals is a custom signal entered into said memory by a user, via said selection means.

14. The signal beacon according to claim 1, wherein a battery port is contained within said housing, whereby said battery port is capable of retaining a battery to power said signal beacon.

15. A signal beacon, comprising:

an arm band adapted to be worn around the arm;

a housing, coupled to said arm band, said housing having a top surface that faces generally upwardly when said signal beacon is worn on the arm;

a plurality of LEDs disposed on said top surface, wherein said LEDs are oriented to transmit light in a generally upward direction; and control means disposed within said housing for controlling said LEDs, wherein said control means includes a single push button operable to generate a pulse for each activation of said push button by said user within a given time interval;

a counter for sensing predetermined user changes to said control means, said counter responsive to said generated pulses within said given time interval for counting the number of pulses received to produce an output signal indicative of the number of times said push button was depressed during said given time interval; and decoding means coupled to said counter for decoding said output signal into a binary signal code that corresponds to each of a plurality of flashing signals transmitted by said LEDs.

16. The signal beacon according to claim 15, further including a filter cap, selectively attachable to said top surface, wherein said filter cap covers said LEDs and only permits infrared light from said LEDs to pass therethrough.

17. The signal beacon according to claim 15, wherein said LEDs transmit infrared light.

18. The signal beacon according to claim 15, wherein said push button is operable for selecting one of said plurality of flashing signals.

19. The signal beacon according to claim 15, wherein at least one of said flashing signals is a morse code signal.

20. The signal beacon according to claim 18, wherein said control means includes a memory and at least one of said flashing signals is a custom signal entered into said memory by a user, via said at least one push button.

* * * * *